United States Patent [19]

Olson

[11] 4,023,621

[45] May 17, 1977

[54] WATER BLANKET DELUGE SYSTEM

[76] Inventor: Benjamin F. Olson, 819 W. 22nd St., No. 2, Tempe, Ariz. 85282

[22] Filed: June 21, 1976

[21] Appl. No.: 697,726

[52] U.S. Cl. ..... 169/68; 62/64; 239/500; 239/567

[51] Int. Cl.[2] ..... A62C 35/22

[58] Field of Search ..... 169/68, 56, 66; 165/115; 62/64; 239/567, 518, 500

[56] References Cited

UNITED STATES PATENTS

| | | | |
|---|---|---|---|
| 1,831,880 | 11/1931 | Pierce | 239/208 X |
| 3,837,405 | 9/1974 | Huddle | 239/209 X |

*Primary Examiner*—Evon C. Blunk
*Assistant Examiner*—Michael Mar
*Attorney, Agent, or Firm*—Warren F. B. Lindsley

[57] ABSTRACT

A water blanket deluge device and system for delivering a continuous layer of water over the surface of a metal tank to keep the vessel and its contents cool primarily as protection against tank overheating by exposure to nearby fires and secondarily as a temperature control means for the contents of the tank.

10 Claims, 9 Drawing Figures

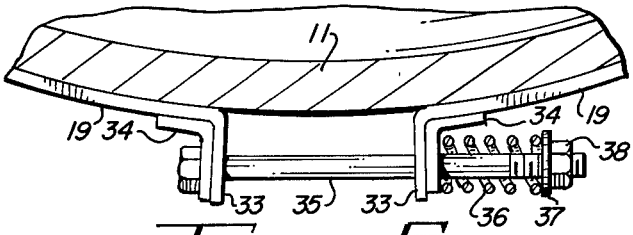
FIG. 6
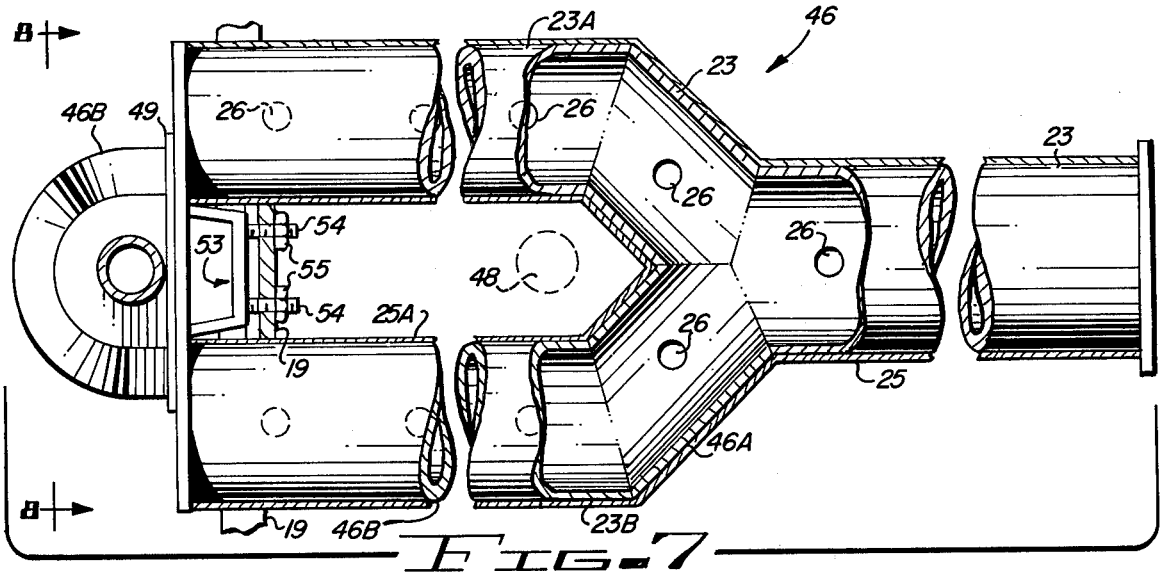
FIG. 7
FIG. 8
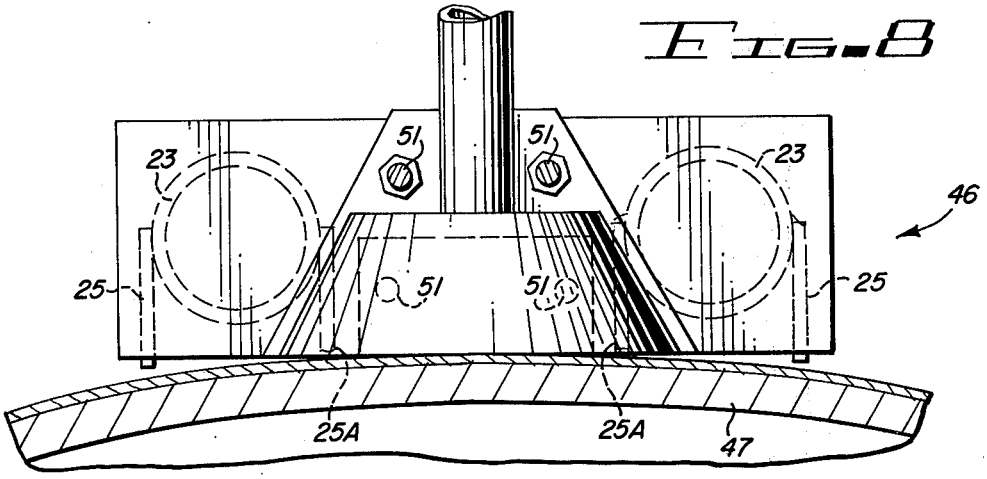
FIG. 9
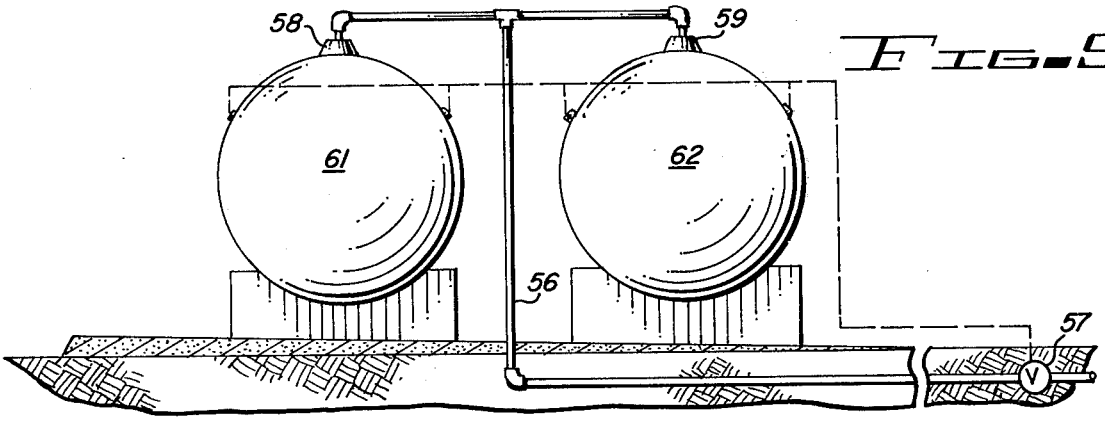

WATER BLANKET DELUGE SYSTEM

BACKGROUND OF THE INVENTION

There have been a number of occasions recently in which tanks holding explosive, toxic, or otherwise dangerous gases or liquids have been ruptured as the result of exposure to the heat of nearby fires. Stationary tanks containing pressurized gas and/or liquid have been exploded by heat radiated from burning buildings. Tanker trucks involved in accidents often survive the initial impact without sustaining ruptured tanks but if the truck catches fire as a result of the crash, the tank may then be ruptured due to overheating. Once the rupture occurs fire fighting and rescue operations become seriously complicated. The surrounding area must be evacuated and exposed bystanders may become seriously ill or lose their lives as the result of the ensuing secondary fires, explosions or release of toxic gases and fumes.

It is a well established fact that if a curtain of water can be provided around or on the surface of a tank or vessel, the tank and its contents can be protected thereby against fire damage. This protection occurs due to the fact that radiant heat from a nearby fire will be prevented from reaching the tank or its contents as it is absorbed by the intervening curtain of water. The heat so absorbed will heat the water, and if of sufficient intensity, will vaporize a portion of the water. The temperature of the tank and its contents are thus limited at worst to the boiling point of water.

DESCRIPTION OF THE PRIOR ART

Devices similar in nature to that of the present invention have been proposed which afford protection against nearby fires by deluging an object with water. Pierce (U.S. Pat. No. 1,831,880) utilized a spray of water issuing from holes in a pipe running along the peak of a roof to protect a building against fire. Gorand (U.S. Pat. No. 2,994,383) and Powell (U.S. Pat. No. 3,019,843) disclose devices for protecting tanks. In none of these disclosures, however, is the water dispensed in the ideal manner proposed in the present invention, i.e., as a continuous sheet which completely covers the surface of the tank and thereby provides a maximum degree of protection. More specifically, the prior art devices have not provided a water dispensing means which adequately meets the requirements of the application.

SUMMARY OF THE INVENTION

In accordance with the invention claimed, an improved water dispensing device and system is provided for producing over the surface of a metal tank or vessel a continuous sheet of water as a means of protection against overheating from exposure to nearby fires.

It is, therefore, one object of this invention to provide an improved water dispensing device for supplying water to the surface of a tank or vessel as a means for protection against overheating due to radiation or direct flame impingement from nearby fires.

Another object of this invention is to provide such a device which dispenses the water in the form of a continuous sheet which completely covers the surface of the tank or vessel to be protected.

A further object of this invention is to provide such a device in a modular form which permits its assembly from a standard set of subassemblies to meet the variety of dimensional requirements for a wide range of applications.

A still further object of this invention is to provide in such a device a convenient means for its attachment to a cylindrical tank which is to be adapted for protection.

A still further object of this invention is to provide in connection with the device a complete protection system which includes means for delivery of the water to the device and means for initiating the flow of the water when the need for protection arises.

A still further object of this invention is to provide such a device and its associated accessories in a form which is readily and inexpensively manufacturable from standard pipe and metal plate stock.

Yet another object of this invention is to provide in such a device and system a capability for adaptation to other uses such as temperature control in which the temperature of the contained liquid or gas is to be regulated during a reaction or process or storage.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which:

FIG. 6 is a cross-sectional view taken at the underside of the tank of FIG. 1 and showing details of a steel band employed in the attachment of the water deluge device to the tank;

FIG. 7 is a top view of a variation of the device of the invention with portions of the device cut away to clarify its construction;

FIG. 8 is an end view of the structure of FIG. 7 taken along line 8—8 of FIG. 7; and FIG. 9 is an illustration of an installation of the device and system of the invention for the protection of two stationary steel tanks mounted side-by-side.

DESCRIPTION OF THE PREFERRED EMBODIMENT

Figure 1:
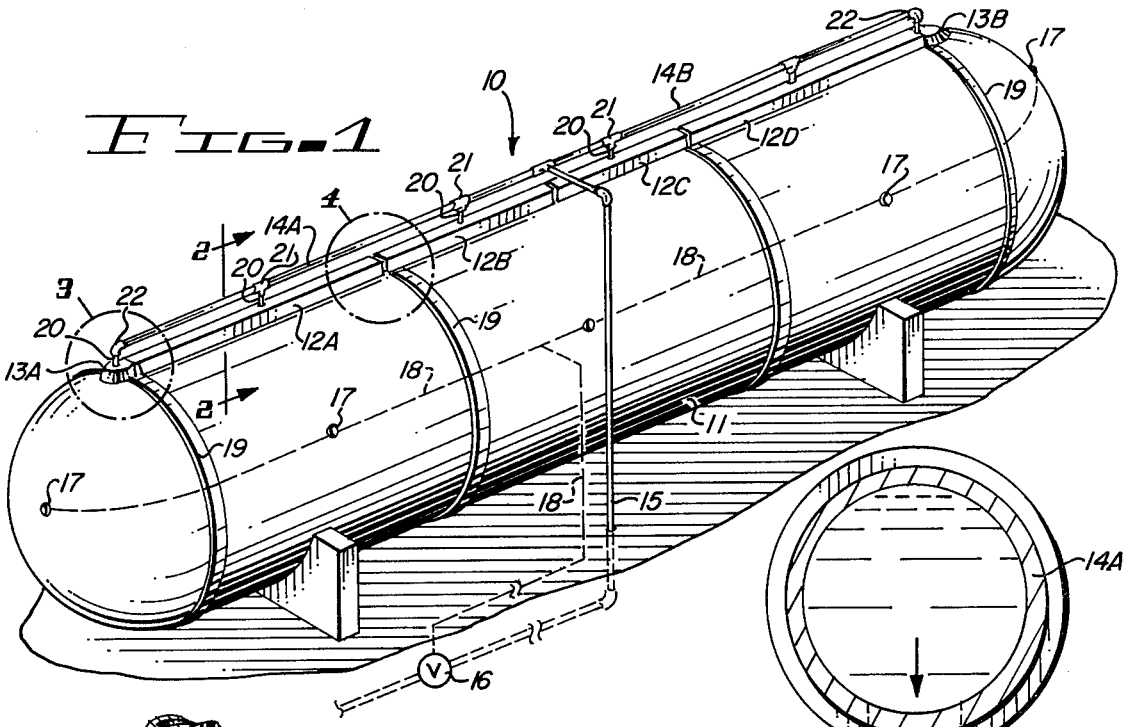
FIG. 1 is a perspective view of a stationary metal storage tank with the water blanket deluge device and system of the invention installed.

Referring more particularly to the drawing by characters of reference, FIG. 1 discloses the water blanket deluge system 10 of the invention as installed on a stationary metal storage tank 11. The water blanket deluge system 10 comprises a water discharge header or "spine" in the form of one or more abutting water discharge devices 12A-12D, two end spreading discharge devices 13A and 13B, water delivery pipes 14A and 14B, a water supply line 15, a remote automatic valve 16, and a number of temperature sensors 17 arranged near the surface of the tank 10 and connected by a control line 18 to actuate valve 16.

The water discharge devices 12A-12D are arranged in a row, end-to-end along the top of tank 11 extending along the total length of the tank shell and the discharge devices 13A and 13B are mounted one at each end of tank 11 at the ends of the row of devices 12A-12D. Running parallel to and directly above the aligned devices 12A-12D are the water delivery pipes 14A and 14B, pipe 14A laying directly above devices 12A and 12B and pipe 14B lying directly above devices 12C and 12D.

The devices 12A-12D, 13A and 13B are attached to tank 11 by means of steel bands 19. The abutting ends of pipes 14A and 14B are fed by water supply line 15 which is in communication with a water supply source connected through valve 16. Water from pipes 14A and 14B is fed to devices 12A-12D, 13A and 13B through connecting pipe stubs 20 which are attached to pipes 14A and 14B by means of "T" fittings 21 and "L" fittings 22.

Figure 2:
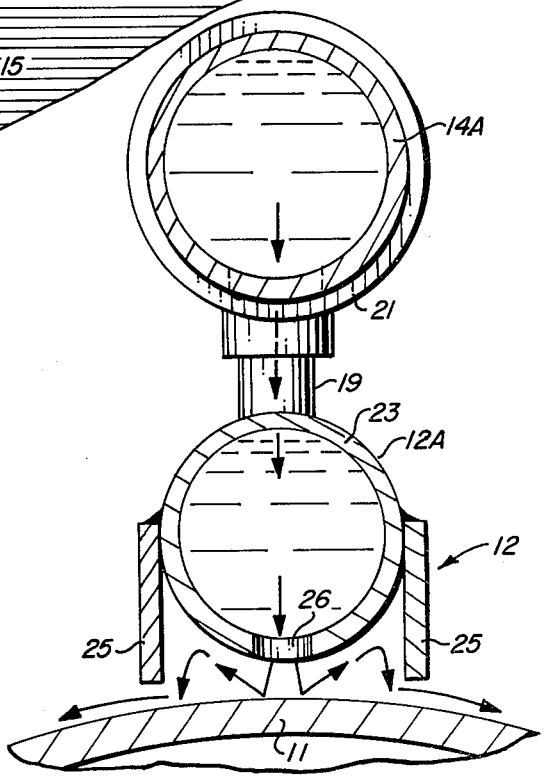
FIG. 2 is a cross-sectional view of the device of the invention as seen along line 2—2 of FIG. 1.
Figure 4:
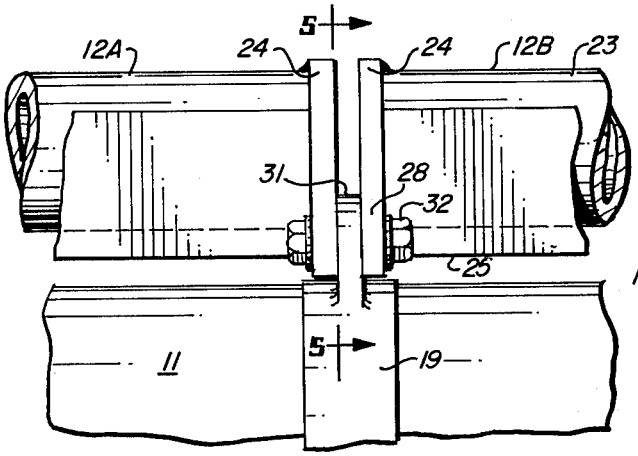
FIG. 4 is a side view of two abutting water deluge devices, the view of FIG. 4 being an enlargment of area 4 of FIG. 1.
Figure 5:
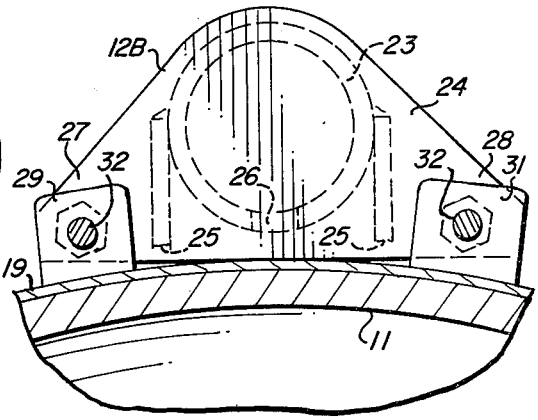
FIG. 5 is a cross-sectional view of the assembly of FIG. 4 taken along line 5—5 of FIG. 4.

As shown most clearly by FIGS. 2, 4 and 5, each of the discharge devices 12A-12D comprises a length of cylindrical pipe 23 closed at each end by a transverse plate 24 and fitted at each side with an apron 25 the two portions of which extend vertically downward from the ends of a horizontal diameter of pipe 23 to a level somewhat below the under surface of pipe 23. The apron 25 extends the full length of the discharge device 12. Arranged along the bottom of pipe 23 lengthwise is a series of holes 26 through which water is released to the surface of tank 11. When the discharge device 12 is properly mounted to tank 11, the lower edge of apron 25 is positioned approximately ¼ inch above the outer surface of the tank.

Transverse plate 24 extends beyond the outer diameter of pipe 23 at both sides forming ears 27 and 28 which carry holes for attachment to bands 19. Correspondingly positioned tabs 29 and 31 extending vertically from the top center of band 19 are fastened by means of bolts 32 to the ears 27 and 28. The band 19 surrounds the tank 11 circumferentially, its ends coming together at the bottom of tank 11 where they are fastened together as shown in FIG. 6. Each end of band 19 is seen to be bent outward at a right angle to form a fastening tab 33, the tab 33 being reinforced by an angle bracket 34 welded thereto. A bolt 35 is passed through aligned holes in the two reinforced tabs 33, and through a compression spring 36 and a washer 37 prior to the adding of nut 38. The unt is then tightened down against the pressure of spring 36, the spring assuring a relatively constant clamping pressure for band 19 independent of the relative thermal expansion of band 19 and tank 11.

The end-spreading discharge device 13A which is supported at the outboard end of device 12A comprises a skirt 39 which is fed from above by one of the stubs 20 connected by the "L" fitting 22 to water delivery pipe 14A. The skirt 39 is shaped something like the cowcatcher of a locomotive, its lower edge clearing the surface at the top of the tank end by a fraction of an inch and its peripheral walls sloped so as to direct the discharged water as a continuous sheet along the surface of the tank in such a manner as to cover substantially the total surface of the end of tank 11.

Figure 3:
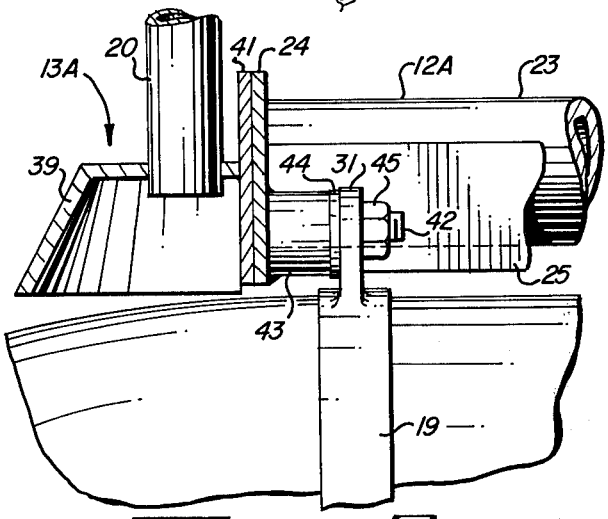
FIG. 3 is a cross-sectional view of an adaptation of the primary device of the invention for use in supplying water to the end of the tank, the view of FIG. 3 being taken in the area 3 of FIG. 1.

The inboard end of device 13A is closed by a vertical plate 41 which is similar in shape to plates 24 which close the ends of devices 12A-12D. In place of the holes provided in plates 24, however, plate 24 adjacent to plate 41 carries two threaded studs 42, each welded at one end to the surface of plate 41 so as to extend horizontally inboard in alignment with the holes of plate 24. The mounting of device 13A and the outboard end of device 12A is accomplished as shown in FIG. 3 by passing the studs 42 through the holes in plate 24 of device 12A, then through cylindrical spacers 43, washers 44, and finally through the tabs 29 and 31 of band 19. One spacer 43 and one washer 44 is provided at each side of device 13A. Two nuts 45, one on each of the studs 42 secure the assembly. The spacers 43 permit the location of band 19 farther inboard from the end of tank 11 away from the rounded end where a more secure grip against the surface may be obtained.

Device 13B is identical to device 13A.

Pressurized tanks are commonly provided with pressure relief valves or other fittings located along the top centerline where they would interfere with the installation of the devices 12A-12D. To cope with such situations a variation of device 12A is provided as illustrated in FIGS. 7 and 8.

FIGS. 7 and 8 show a bifurcated discharged device 46 which is intended to circumvent a centerline fitting at the end of tank 47 and at the same time to supply water to the end surface of the tank 47. The device 46 comprises a "Y" section 46A and an end section 46B.

"Y" section 46A is similar in construction to sections 12A-12D of FIGS. 1–5 in the sense that is employs again a cylindrical pipe 23 fitted at each side with an apron 25 and perforated along its bottom centerline by holes 26 for the discharge of water. As shown in FIG. 7, however, the section 46A makes a transition from a single channel at the right to a double or split channel at the left, the transition taking the form of a "Y" in which the upper arms of the "Y" pass around on both sides of a pressure relief valve vent or other fitting 48 located at the top centerline.

The apron 25 along the outside periphery of section 46A clears the surface of the tank 47 again by approximately ¼ inch. Inside the arms of the "Y", however, the apron 25A has substantially less clearance from tank 11, thus permitting a small amount of water to surround fitting 48.

The end section 46B may be similar to end section 13A of FIG. 3 except that plate 41 of section 13A with its connecting studs 42 is replaced by a simple flat plate 49 which is attached by spot welds 51 or other means to a large transverse plate 52 which covers the outboard ends of the pipes 23A and 23B forming the arms of "Y" section 46A.

Located between the arms of "Y" section 46A and attached to the inboard vertical surface of plate 52 is a mounting bracket 53. Two threaded studs 54 extend horizontally inboard from bracket 53 in alignment with the holes in the tabs 29 and 31 of band 19 to permit mounting thereto as in the case of the other devices 12A-12D, 13A and 13B. The studs 54 are secured to the tabs 29 and 31 by means of nuts 55.

In the operation of the system 10 of FIG. 1 upon the occurrence of a nearby fire, excessive temperatures at the surface of tank 11 as recognized by the sensors 17 cause the sensors 17 to dispatch signals along line 18 to the remote automatic valve 16. Valve 16 responds by opening and permitting the passage of water via line 15 and pipes 14A and 14B to discharge devices 12A-12D, 13A and 13B. The water enters the discharge devices through fittings 21 and 22 and through the studs 20. Because the diameters of the line 15 and the pipes 14A and 14B are large relative to the flow rate permitted by the discharge devices, the pipes 23 of devices 12A-12D are filled with water so that uniform distribution to all of the holes 26 along the entire length of tank 11 is assured. The water leaving holes 26 strikes the surface of tank 11 at a right angle and rebounds upward in a conical pattern which is confined by apron 25. The water substantially fills the space under the devices bounded by apron 25 and discharges as a continuous sheet through the ¼ inch opening between the lower edge of aprons 25 and the surface of tank 11. surface tension sustains the integrity of the blanket or sheet of water leaving the discharge devices so that coverage is continuous over the side of tank 11, the water hugging the surface of the tank to a point near the bottom centerline where it falls to the ground. The continuity of the sheet of water enhances the tendancy of the water sheet to cling to the tank surface as it flows downward.

Water leaving the end-discharge devices 13A and 13B is spread out to cover the total surface of the head of the tank by the semi-circular distribution chamber formed by skirt 39.

As indicated earlier, the system 10 may be employed with minor modifications for temperature control of a liquid or gas contained by tank 11. In this case the water is employed to absorb and carry away exothermic chemical reaction heat or radioactive decay heat. Thermostatic control of water flow is employed in this case, the thermostats sensing the temperature of the cooled medium.

System 10 may, of course, be expanded to provide for the protection or cooling of more than one tank as shown in FIG. 9 where water from a common supply line 56 controlled by a single automatic valve 57 is delivered to two headers or spines 58 and 59 installed at the tops of two tanks 61 and 62 located side-by-side. The tanks 61 and 62 may be cylindrical as in FIG. 1 or they may be spherical. For the spherical tanks a variation of the end-discharge device would be employed, the variation comprising a complete circular rather than a semi-circular skirt.

It should be noted that systems 11 and 46 may contain any combination of single and double or juxtapositioned water discharging pipe sections and fall within the scope of this invention.

Thus, an effective and complete water deluge system is provided together with the novel discharge devices in accordance with the stated objects of the invention. Although but a few embodiments of the invention have been illustrated and described, it will be apparent to those skilled in the art that various changes and modifications may be made therein without departing from the spirit of the invention or from the scope of the appended claims.

What is claimed is:

1. A liquid deluge device for delivering a continuous layer of liquid over the surface of a metal tank to keep it cool comprising:

a liquid discharge header of one or more fluid conducting conduits rigidly mounted on and above the top surface of the tank and extending longitudinally thereof, said header being perforated at intervals along its length for discharging liquid directly onto the top surface of the tank, an apron comprising two portions one extending downwardly from each side of said header toward the tank on opposite sides of its longitudinal axis to a level below the surface of said header and said perforations juxtapositioned to the tank, said portions extending substantially the full length of the header, whereby liquid under pressure released by said perforations strikes the surface of the tank at substantially a right angle thereto, rebounds angularly away therefrom within said aprons, the liquid substantially filling the inside of said aprons being discharged therefrom in a continuous sheet through the spacing between the edges of said portions of the apron juxtapositioned to the tank and the surface of the tank and flowing over and hugging the surface of the tank to substantially the bottom of the tank where it drops away therefrom.

2. The liquid deluge device set forth in claim 1 wherein:

said apron discharges liquid simultaneously over both sides of the tank.

3. The liquid deluge device set forth in claim 1 in further combination with:

means for closing the end of said apron.

4. The liquid deluge device set forth in claim 1 wherein:

the two portions of said apron extend downwardly from each end of a diameter of said header toward the tank.

5. The liquid deluge device set forth in claim 1 wherein:

the water released by said perforations strikes the surface of the tank at substantially a right angle thereto, rebounds angularly away therefrom in a conical pattern.

6. The liquid deluge device set forth in claim 1 wherein:

the liquid flows over and hugs the surface of the tank to substantially the bottom center line of the tank where it drops away therefrom.

7. The liquid deluge device set forth in claim 1 wherein:

the liquid is water.

8. The liquid deluge device set forth in claim 7 in further combination with:

means for connecting a source of water under pressure to said header, one or more temperature sensors for mounting on the tank, valve means mounted in said means for connecting said header to a source of water under pressure, and means connecting said sensors to said valve means for energizing said valve means to transmit water under pressure to said header upon said sensors noting a predetermined temperature of the tank.

9. The liquid deluge device set forth in claim 8 in further combination with:

a water delivery pipe juxtapositioned to and substantially parallel with said header on its side opposite to the tank, and means for interconnecting said delivery pipe to said header for furnishing sufficient water under pressure to keep said header full during operation.

10. The liquid deluge device set forth in claim 1 in further combination with:

a second liquid discharge header and apron substantially similar to said header and apron, each header being mounted on opposite sides of the tank longitudinally thereof, whereby each header and apron discharges a sheet of water over one side only of the tank.

* * * * *